US011808106B2

(12) United States Patent
Wood et al.

(10) Patent No.: US 11,808,106 B2
(45) Date of Patent: Nov. 7, 2023

(54) MULTI-STAGE HYDRAULIC FRACTURING TOOL AND SYSTEM

(71) Applicant: 8SIGMA ENERGY SERVICES INCORPORATED, Alberta (CA)

(72) Inventors: Blake Wood, Alberta (CA); Nigel Dabreo, Alberta (CA)

(73) Assignee: 8SIGMA ENERGY SERVICES INCORPORATED, Calgary (CA)

( * ) Notice: Subject to any disclaimer, the term of this patent is extended or adjusted under 35 U.S.C. 154(b) by 0 days.

(21) Appl. No.: 16/866,120

(22) Filed: May 4, 2020

(65) Prior Publication Data

US 2020/0347693 A1 Nov. 5, 2020

Related U.S. Application Data

(60) Provisional application No. 62/842,779, filed on May 3, 2019.

(51) Int. Cl.
*E21B 33/129* (2006.01)
*E21B 33/12* (2006.01)

(52) U.S. Cl.
CPC ..... *E21B 33/1292* (2013.01); *E21B 33/1204* (2013.01); *E21B 33/1208* (2013.01)

(58) Field of Classification Search
CPC ..... E21B 33/1204; E21B 33/1208; E21B 33/1277; E21B 33/1292
See application file for complete search history.

(56) References Cited

U.S. PATENT DOCUMENTS

| | | | | |
|---|---|---|---|---|
| 3,819,850 | A * | 6/1974 | Perry | H02G 5/002 174/DIG. 7 |
| 4,098,334 | A * | 7/1978 | Crowe | E21B 23/06 166/182 |
| 9,534,471 | B2 * | 1/2017 | Etzel | E21B 43/14 |
| 2007/0221384 | A1 * | 9/2007 | Murray | E21B 34/063 166/185 |
| 2015/0167428 | A1 * | 6/2015 | Hofman | E21B 43/26 166/373 |
| 2019/0153816 | A1 * | 5/2019 | Campbell | E21B 34/14 |
| 2019/0352998 | A1 * | 11/2019 | Wolf | E21B 33/128 |

FOREIGN PATENT DOCUMENTS

| | | | | |
|---|---|---|---|---|
| WO | WO-2016028154 | A1 * | 2/2016 | E21B 34/063 |

* cited by examiner

*Primary Examiner* — Giovanna Wright
*Assistant Examiner* — Ronald R Runyan
(74) *Attorney, Agent, or Firm* — Ridout & Maybee LLP

(57) ABSTRACT

The present invention provides an actuation member for traveling down a borehole of a casing to engage with one or more geometrical profile locations provided inside the casing, and a system for controllably exposing selected locations along the wellbore to a pressurized fluid. The actuation member comprises a generally cylindrical hollow body extending between an uphole end and a downhole end, and a plug seat configured to receive a plug for blocking the borehole. The actuation member has two edge portions separate and movable relative to one another to facilitate resilient deformation of the hollow body, wherein the deformation causes a reduction of cross-sectional area of the hollow body. An outer surface of the hollow body comprises one or more protrusions and/or grooves configured to matingly engage with the one or more geometric profile locations in the casing.

27 Claims, 14 Drawing Sheets

MULTI-STAGE HYDRAULIC FRACTURING TOOL AND SYSTEM

FIELD

The present invention pertains to the field of oil and gas reservoir hydraulic fracturing in general and in particular to multi-stage hydraulic fracturing involving controlled exposure of selected locations along a wellbore to create multiple fracture treatments from the wellbore.

BACKGROUND

Multi-stage hydraulic fracturing methods typically require the use of multiple isolation members installed sequentially in the wellbore that allow for sequential isolation and treatment of the wellbore and reservoir intervals. Typically, the sequential isolation and fracturing treatment of the wellbore is completed from the lower end to the upper end as this is the most efficient operationally and the lowest risk method. Isolation members can be wireline set bridge plugs, graduated balls with graduated ball seats, balls with ball seats in a 'counting' or 'ratcheting' style of system, actuation members that have geometric profiles on them that only will engage a corresponding geometric profile location in the wellbore, as well as coiled tubing run packers as well as others.

Plug-and-perf treatment includes pumping down a bridge plug on wireline with perforating guns to a given horizontal location near the toe of the well. The plug is set, and the zone is perforated. The tools are then removed from the well, and the fracture stimulation treatment is pumped in. The set plug or ball-activated plug then diverts fracture fluids through the perforations into the formation. The stage is completed, the next plug and perforations are initiated, and the process is repeated moving back to the heel of the well.

U.S. Pat. No. 6,222,350 discloses a graduated ball activated sliding sleeve style system, which uses balls pumped from surface as the isolation members. This system involves the sliding sleeve ball drop method which uses graduated ball size functionality. This process involves first installing a production casing or liner having ports, wherein are covered with sliding sleeves. Each sleeve has a ball seat of a different and gradually larger diameter. To pump a fracture treatment, a ball is dropped into the wellbore and is pumped down to its corresponding size of ball seat where it lands and forms at least a partial seal. Pressure is increased in the upper portion of the wellbore above the seated ball until a shear member in the sleeve shears from the pressure differential, causing the now free sliding sleeve to move deeper into the wellbore and exposing a now opened port between the wellbore and the reservoir. In this method, the ball and ball seat are the isolation member. The fracture treatment is then pumped through that port until completed. Then the next larger ball is then dropped which will land and seal at the next shallowest stage. The process repeated until all desired stages have been opened and fracked. Each fracturing stage is isolated from the one below it with a slightly larger ball. The system has a finite number of stages because the size of the balls eventually increases to a size that is too large to be pumped down the wellbore. The major drawback to this method is that the number of stages is limited by the diameter of the casing, which limits the number of balls used and in turn the number stages that can be fractured. Another drawback is that the ball seats are restrictions in the wellbore that will restrict well production or need to be milled out with coiled tubing increasing well costs.

Coiled tubing activated sliding sleeves use a packer and slips on the bottom hole assembly of coiled tubing to seal and engage on a sliding sleeve. The well is then pressured up which transmits a hydraulic force to the sliding sleeve shearing it open and exposing ports that a fracture placement may be pumped through. In this method the seals and slips on the bottom hole assembly act as the isolation member. The limitation of the method is that coiled tubing is required adding extra costs. Also, because coiled tubing is required, the lateral length that sleeves can be actuated is limited to as far as coiled tubing can reach. Coiled tubing cannot reach the same lateral lengths of casing as casing can be buoyed and or rotated to bottom increasing reach. The benefit of this type of method is that an unlimited number of intervals may be fractured. Another benefit is that if a screenout is experienced during fracturing it can easily be cleared via circulation and the next uphole stage can be easily opened to regain connectivity to the reservoir. Coiled tubing activated sliding sleeves are undesirable as the need for coiled tubing limits the horizontal reach of the well as well as coiled tubing units are expensive. Having coiled tubing in the well during fracture treatments increases pumping pressures and limits treatment pump rates.

Actuation member activated sliding sleeve systems, involve first, installing a casing or liner having ports, which are covered with sliding sleeves. Each sliding sleeve has a profile and each profile has a corresponding actuation member with a matching profile. To pump a fracture treatment, a actuation member is dropped into the wellbore and is pumped down to its corresponding sliding sleeve where it mates, engages and at least partially forms a seal. Pressure is increased in the upper portion of the wellbore above the engaged plug until a shear member in the sleeve shears from the pressure differential, causing the now free sliding sleeve to move deeper into the wellbore and exposing a now opened port between the wellbore and the reservoir. The fracture treatment is then pumped through that port until completed. Then the next sequential actuation member is pumped down the well which would land and seal at the next shallowest stage. The process repeated until all desired stages have been opened and fracture treatments placed. Each fracturing stage is isolated from the one below it with a sequentially landed actuation member. These systems have a less finite number of stages than ball drop systems because there is more room to grow a geometrical shape on the actuation member length than there is to grow ball diameters and ball seat inner diameters. Three hundred single point of entry fracture intervals can be easily obtained with these style of systems.

The actuation members generally cannot be milled out economically because they are made from high strength metals and it is also not economically feasible to retrieve them with coiled tubing or wireline because of the large number of runs in and out of the well required as well as the horizontal reach limitations of coiled tubing and wireline. Actuation member activated sliding sleeve systems have further limitations, as the actuation member once mated to the sliding sleeve becomes a restriction in the wellbore that has a smaller inner diameter than that of casing. These restrictions in the well have many operational drawbacks and limitations and can cause significant well and production problems. The restrictions can initiate produced sand bridges that need to be cleaned out with coiled tubing. The restrictions limit what remedial operations can be performed on the wellbore, including limiting the chance of a recompletion operation being performed successfully.

It would be beneficial to have an actuation member constructed of a dissolvable or degradable or millable material as this would remove the problematic actuation member restriction in the wellbore—allowing remedial operations to be completed, production to be increased through the removal of restrictions and reduce the amount of sand bridges experienced during hydrocarbon production due to restrictions.

The problem with degradable, dissolvable and millable materials is that they have low material yield strengths usually around 30-50 ksi and will not work in a colleted style design as collets inherently have a low circumferential area of material available to resist frac-forces and bending placed on the actuation member collets. Prior art actuation members have all been of a colleted or segmented design and need to have material strengths of around 80 ksi or greater, are not millable or degradable or dissolvable.

Therefore, there is a need for an actuation member and a system for multistage hydraulic fracturing that is not subject to one or more limitations of the prior art.

This background information is provided to reveal information believed by the applicant to be of possible relevance to the present invention. No admission is necessarily intended, nor should be construed, that any of the preceding information constitutes prior art against the present invention.

SUMMARY OF INVENTION

An object of the present invention is to provide a multistage hydraulic fracturing tool and system.

In accordance with an aspect of the present invention, there is provided an actuation member for travelling down a borehole of a casing disposed in a wellbore to engage with one or more geometrical profile locations provided inside the casing. The actuation member comprises a generally cylindrical hollow body extending between an uphole end and a downhole end, and has two proximate edge portions extending between the uphole end and the downhole end. The two edge portions being separate and movable relative to one another to facilitate resilient deformation of the hollow body, wherein the deformation causes a reduction of cross-sectional area of the hollow body. The actuation member also comprises a plug seat configured to receive a plug for blocking the borehole, and an outer surface of the hollow body comprises one or more protrusions and/or grooves configured to matingly engage with the one or more geometric profile locations in the casing, the mating engagement facilitated by the deformation of the hollow body.

In accordance with another aspect of the present invention, there is provided a system for controllably exposing selected locations along a wellbore to a pressurized fluid. The system comprises: a casing for disposal within the wellbore, the casing defining an internal borehole extending longitudinally within the wellbore, the casing having one or more geometrical profile locations provided on inner side thereof; and an actuation member for travelling down the borehole of the casing when disposed in the wellbore to engage with the one or more geometrical profile locations The actuation member comprises a generally cylindrical hollow body extending between an uphole end and a downhole end, and having two proximate edge portions extending between the uphole end and the downhole end. The two edge portions being separate and movable relative to one another to facilitate resilient deformation of the hollow body, wherein the deformation causing a reduction of cross-sectional area of the hollow body. The actuation member also comprises a plug seat configured to receive a plug for blocking the borehole, and an outer surface of the hollow body comprises one or more protrusions and/or grooves configured to matingly engage with the one or more geometric profile locations provided in the casing, the mating engagement facilitated by the deformation of the hollow body.

BRIEF DESCRIPTION OF THE FIGURES

Further features and advantages will become apparent from the following detailed description, taken in combination with the appended drawing, in which.

DETAILED DESCRIPTION

Figure 1:
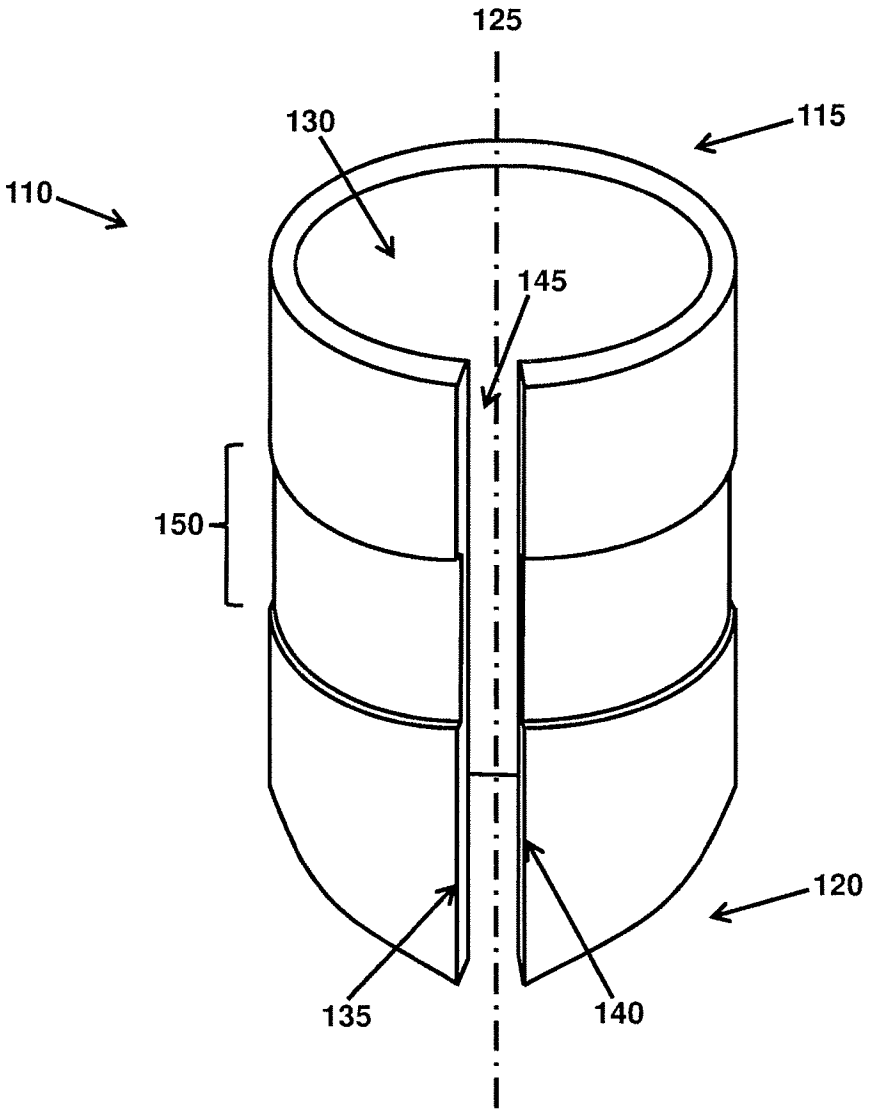
FIG. 1 depicts a perspective view of an actuation member (without a plug seat) in accordance with an embodiment of the present invention.

As used herein, the term "about" refers to a +/−10% variation from the nominal value. It is to be understood that such a variation is always included in a given value provided herein, whether or not it is specifically referred to.

Unless defined otherwise, all technical and scientific terms used herein have the same meaning as commonly understood by one of ordinary skill in the art to which this invention belongs.

Embodiments of the present invention provide for a multi-stage hydraulic fracturing tool and system. The system generally includes an actuation member which travels down a borehole of a casing member to mate with the casing or to mate and move a sliding sleeve member associated with the casing member for uncovering one or more ports in the casing.

The present invention provides an actuation member which does not rely on high strength material for holding back high differential pressures, and for preventing plastic deformation due to collet biasing observed in colleted style actuation members. The actuation member of the present invention can be made from a low strength degradable, dissolvable or millable material.

In one aspect, the present invention provides an actuation member for travelling down a borehole of a casing disposed in a wellbore to engage with one or more geometrical profile locations provided inside the casing.

The actuation member comprises a generally cylindrical hollow body extending between an uphole end and a downhole end and defining an internal aperture (130) which opens at the uphole end and the downhole end. The hollow body has two proximate edge portions (135, 140), in the form of two free ends, that each extend between the uphole end and the downhole end of the hollow body (110) and that define a gap (145) in the wall of the hollow body. The two edge portions (or free ends) (135, 140) are separate and movable relative to one another to facilitate resilient deformation of the hollow body, which allows for a reduction of a cross-sectional area defined by the internal aperture (130) of the hollow body. The actuation member further comprises a plug seat (160) configured to receive a plug (560) for blocking the internal aperture (130) with effect that the borehole is blocked.

The outer surface of the hollow body comprises one or more protrusions and/or grooves configured to matingly engage with the one or more geometric profile locations inside the casing. The resilient deformation of the hollow body caused by the two separate and movable edge portions further facilitate the mating engagement between the actuation member and the casing.

In some embodiments, the one or more geometric profile locations are defined by one or more grooves and/or protrusion provided on the inner surface of the casing wall.

In some embodiments, the casing has one or more ports extending through the casing wall, and the casing further comprises a sliding sleeve member having an aperture for receiving the actuation member therein. The sliding sleeve member is disposed within the borehole to initially cover one of the one or more ports, and also configured to move down hole in response to a predetermined amount of force in a longitudinal direction to uncover the port. In such embodiments, the one or more geometric profile locations are defined by one or more grooves and/or protrusions provided on an inner surface of the sliding sleeve wherein the mating engagement between the actuation member and the sliding sleeve member facilitates downhole movement of the sliding sleeve member along with the actuation member.

The actuation member is configured for travelling down the borehole in a longitudinal direction and matingely engage with the casing member. The configuration includes sizing and shaping of the actuation member to closely match the aperture of casing, placing of a plug member 560 (such as a ball) into a corresponding plug member seat of the actuation member, and providing protrusions and/or grooves corresponding with the grooves and/or protrusions of geometric profile locations in the casing for the mating engagement therewith.

The plug seat can be integral with or coupled to the hollow body. In some embodiments, the plug seat is provided at or towards the uphole end of the hollow body.

The plug seat can be any suitable shape depending upon the shape/configuration of the hollow body. In some embodiments the plug seat is a ring and has grooves on its outer surface for installation of o-rings or other suitable seals or diverter elements.

In some embodiments, the hollow body has a generally C-shaped cross section, wherein the two edge portions are separated by a gap in line with a perimeter of the hollow body. In some embodiments, the two edge portions are separated by a gap spanning an arc of between 5 degrees and 45 degrees.

In some embodiments, the plug seat is a ring-shaped body integral with or coupled to the uphole end of the hollow body.

In some embodiments, the plug seat is coupled to the hollow body by a coupling piece located generally diametrically opposite from the two edge portions. In some embodiments, the coupling piece spans an arc of between 5 degrees and 45 degrees.

In some embodiments, the plug seat is a frictionally engaged wiper member extending across the two edge portion. In some embodiments, the wiper member is coupled to an inner face of a portion of the hollow body proximate to one of the edge portions, such that the wiper member wipingly (i.e. pressingly and frictionally) engages an inner face of another portion of the hollow body proximate to other of the edge portions.

In some embodiments, the hollow body has a generally spiral shape, with a spiral having more than one and less than two rotations. In such embodiments, an outer face of a portion of the hollow body proximate to one of the edge portions wipingly engages an inner face of another portion of the hollow body proximate to other of the edge portions to provide a plug seat at the uphole end portion of the hollow body.

In some embodiments, the hollow body is curved around an axis parallel to a main direction of travel of the actuation member.

In some embodiments, the uphole and the downhole end of the hollow body has generally circular cross section.

In some embodiments, the downhole end of the hollow body comprises a wedge-shaped portion.

In some embodiments, the downhole end of the hollow body is rounded.

In some embodiments, the downhole end of the hollow body is chamfered.

The actuation member is configured to receive plugs of varying shapes and sizes. In some embodiments, the plug is ball shaped. In some embodiments, the plug is cone or wedge shaped.

In some embodiments, at least a portion of the actuation member and/or the plug seat can be formed of dissolvable, degradable and/or millable materials.

In another aspect, the present invention provides a system for controllably exposing selected locations along a wellbore to a pressurized fluid. The system comprises an elongated casing for disposal within the wellbore. The casing defines an internal borehole extending longitudinally with the wellbore. The casing has one or more geometrical profile locations provided on inner side thereof. The casing can be viewed as a structure within the wellbore which is relatively impermeable to hydraulic fracking fluid. The casing can be a unitary structure or can be formed of one or more mating sections.

In some embodiments, the one or more geometric profile locations are defined by one or more grooves and/or protrusion provided on the inner surface of the casing wall.

In some embodiments of the system of the present invention, the casing comprises one or more ports located along the length thereof, and extending through the casing wall. A sliding sleeve member is provided for disposal within borehole of the casing. The sliding sleeve member has an aperture for receiving an actuation member, the sliding sleeve member being configured to initially cover the one or more ports, and configured to move downhole in the longitudinal direction. The one or more geometric profile locations are defined by one or more grooves and/or protrusions provided on an inner surface of the sliding sleeve wherein the mating engagement between the actuation member and the sliding sleeve member facilitates downhole movement of the sliding sleeve member along with the actuation member.

A port can extend partially or fully around the circumference of the casing, and multiple such ports may be provided. The sliding sleeve member can be fixed in place using shear pins or another frangible or disengagable securing members. Once the securing members have been broken due to application of a predetermined amount of force applied in the longitudinal direction, the sliding sleeve member becomes slidable within the borehole. As such, the sliding sleeve member is configured, upon application of the predetermined amount of force in the longitudinal direction to move downhole in the longitudinal direction, thereby uncovering the one or more ports.

The system further comprises an actuation member as described above. As discussed above, the outer surface of the hollow body of the actuation member is provided with one or more protrusions and/or grooves configured to matingly engage with the geometrical profile locations provided inside the casing (i.e. one or more mating grooves and/or protrusions of the inner surface of the casing or the inner surface of the sliding sleeve member).

The actuation member travels down the borehole until it reaches a corresponding geometrical profile location. At this point, the actuation member mateingly engages with the casing.

In the embodiments, wherein the one or more geometrical profile locations are defined by the one or more grooves and/or protrusion provided on an inner surface of a sliding sleeve member being disclosed in the casing, actuation member travels down the borehole until it reaches the sliding sleeve member having protrusions/grooves corresponding to its protrusions/grooves. At this point, the protrusions/grooves matingly fit within the groove/protrusions of the actuation member. This mating engagement allows downhole force to be applied to the sliding sleeve member in order to move the sleeve member downhole, thereby uncovering the associated ports, and this mating engagement is further facilitated by the deformation of the hollow body of the actuation member.

In the embodiments, wherein the one or more geometrical profile locations are defined by the one or more grooves and/or protrusion provided on the inner surface of the casing wall, the casing is configured for "plug and perf" method of fracking. In such embodiments, the casing does not include ports and sliding sleevesln such embodiments, the actuation member travels down the borehole until it reaches a section of the casing member having protrusions/grooves corresponding to protrusions/grooves of the actuation member. At this point the protrusions/grooves of the actuation member and the casing member matingly engage with one another, thereby closing the casing borehole, and allowing release of wire lines to perforate the casing in a section above the actuation member.

The system further comprises a plug member resting on the plug seat, to seal the internal aperture of the actuation member against down hole fluid flow.

The plug members suitable for the actuation member and system of the present invention can at least partially be formed of a dissolvable material, degradable material or a material which is mechanically destructible under a milling or other operation.

To gain a better understanding of the invention described herein, the following examples are set forth with reference to the accompanying drawings, which are not drawn to scale, and the illustrated components are not necessarily drawn proportionately to one another. It will be understood that these examples are intended to describe illustrative embodiments of the invention and are not intended to limit the scope of the invention in any way.

EXAMPLES

Figure 2:
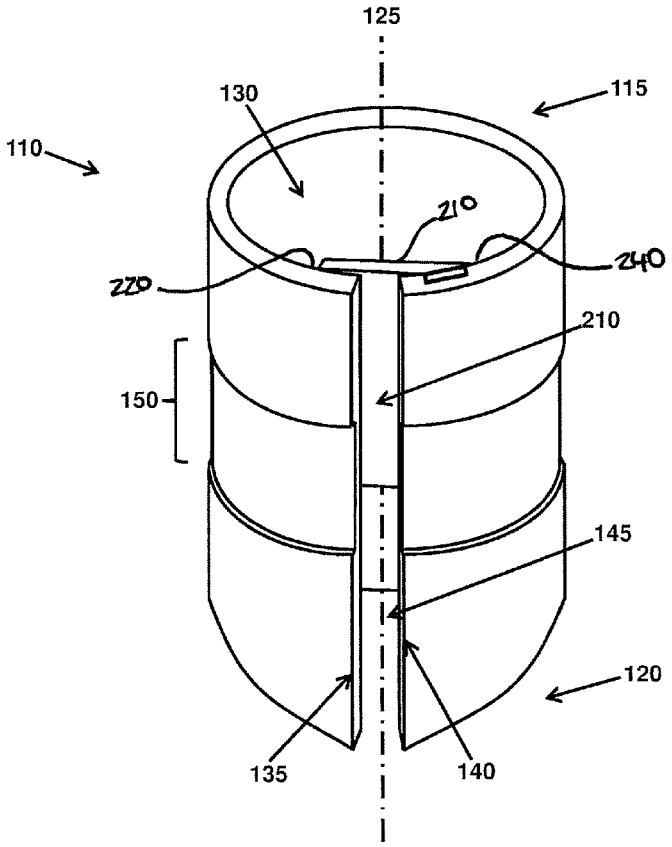
FIG. 2 depicts a perspective view of an actuation member in accordance with an embodiment of the present invention.
Figure 3:
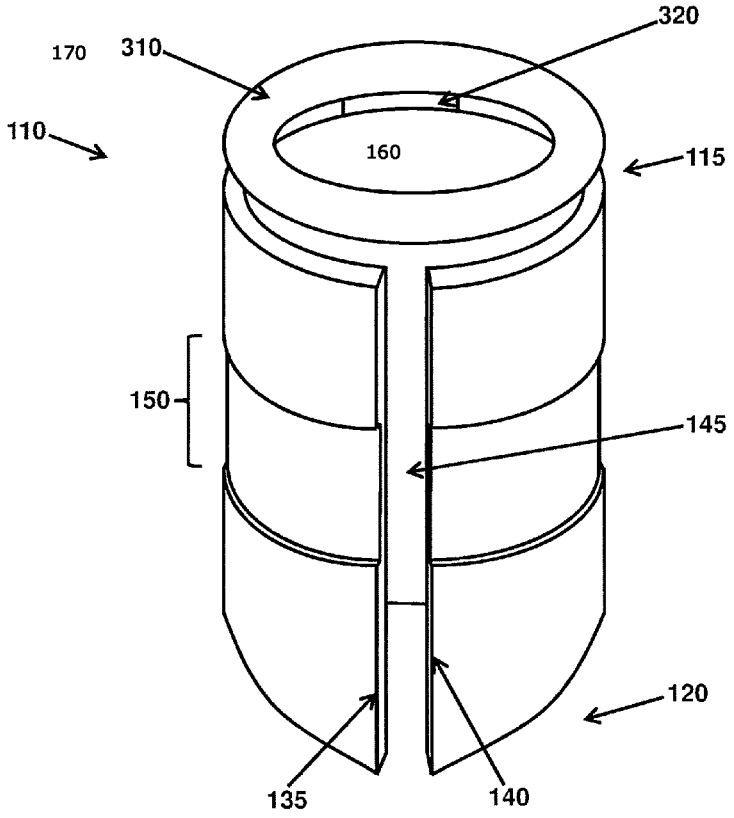
FIG. 3 depicts a perspective view of an actuation member in accordance with another embodiment of the present invention.

FIG. 1 illustrates, in perspective view of an example of the actuation member of the present invention without a separate plug seat, and FIGS. 2 and 3 illustrate examples of the actuation member of the present invention with a plug seat defined by a plug seat-defining member. The actuation member depicted in these figures has a generally cylindrical hollow body (110) having uphole end (115), downhole end (120), and defining an internal aperture (130) which opens at the uphole end and the downhole end. The generally cylindrical hollow body (11) has two proximate edge portions (135, 140) in the form of two free ends that each extend between the uphole and the downhole ends (115, 120) and that define a gap (145) in the wall of the hollow body (110).

In these examples the hollow body (110), is curved around an axis (125) parallel to a main direction of travel of the actuation member.

The outer surface of the hollow body is provided with grooves (150) (and/or protrusion (150')) configured to matingly engage with corresponding protrusions of a sliding sleeve member (not shown).

FIG. 2 depicts a plug seat in the form of a wiper member (210) coupled to a portion of the inner face (240) of the hollow body proximate to the edge portion (140), and extending across the gap between the two edge portions. The wiper member is configured to wipingly/pressingly and frictionally engage a portion of the inner face (220) of the hollow body proximate to edge portion (135).

FIG. 3 further depicts the actuation member including a plug seat-defining member 170 in the form of a ring-shaped plug seat-defining member (310) connected to the uphole end of the hollow body, via a coupling piece (320) located diametrically opposite from the two edge portions.

Figure 4:
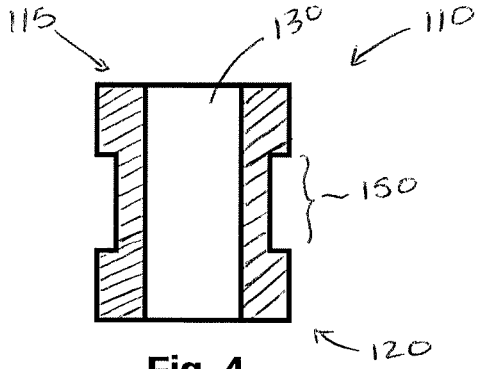
FIG. 4 depicts a cross sectional view of the actuation member of FIG. 1.
Figure 5:
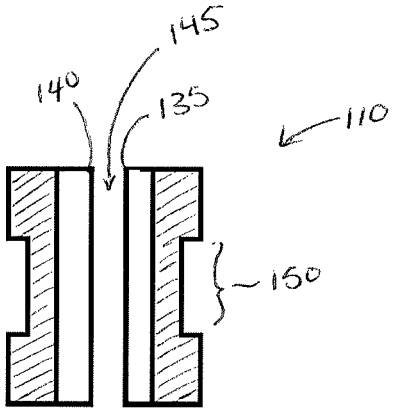
FIG. 5 depicts a cross sectional view of the actuation member of in FIG. 1 wherein the viewpoint is rotated 180 degrees.
Figure 6:
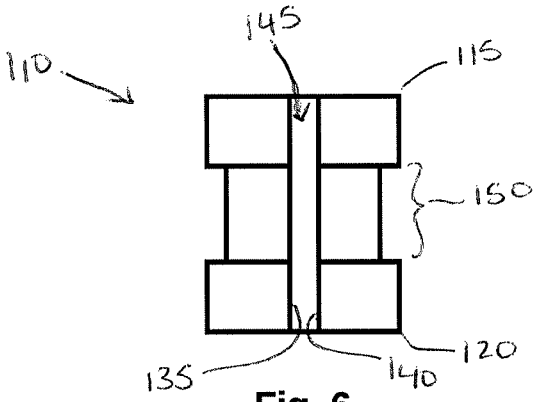
FIG. 6 depicts a front view of the actuation member of FIG. 1.
Figure 7:
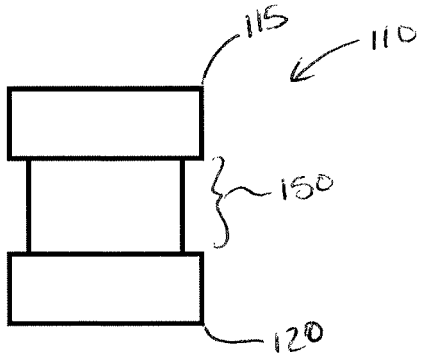
FIG. 7 depicts a side view of the actuation member of FIG. 1.
Figure 8:
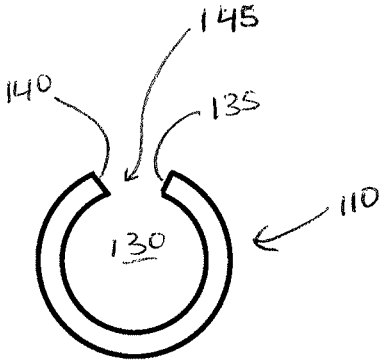
FIG. 8 depicts a bottom view of the actuation member of FIG. 1.
Figure 8A:
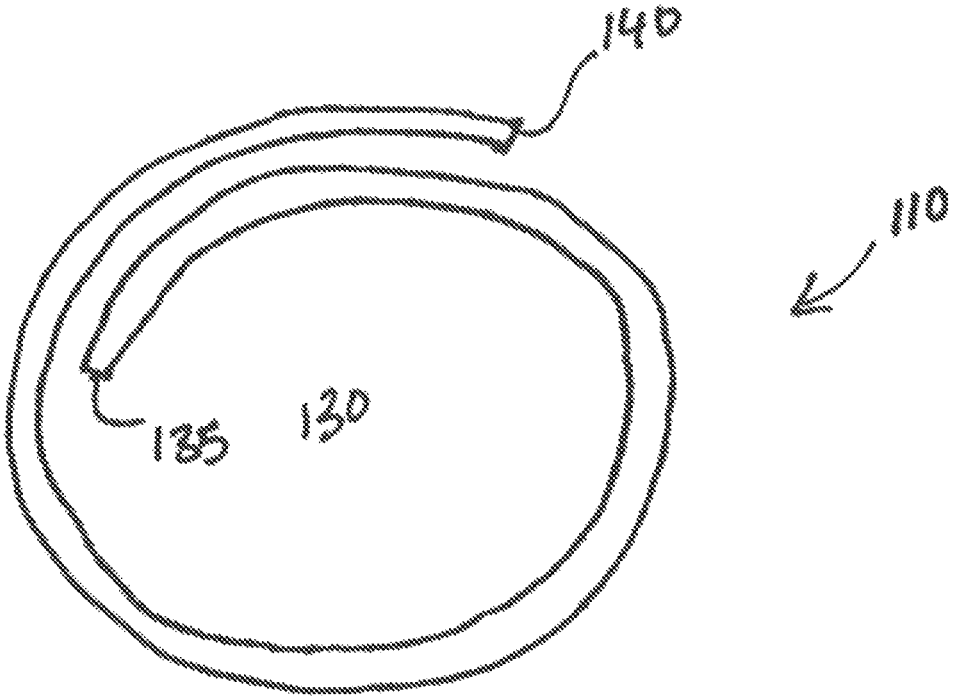
FIG. 8A illustrates a bottom view of an engaging member according to another example embodiment of the present disclosure.
Figure 9A:
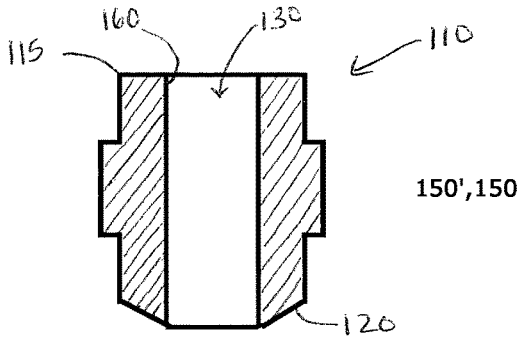
FIGS. 9A-9D depict cross sectional views of actuation members in accordance with embodiments of the present invention, each having a chamfered downhole end and different shaped one or more protrusions on the outer surface.
Figure 9B:
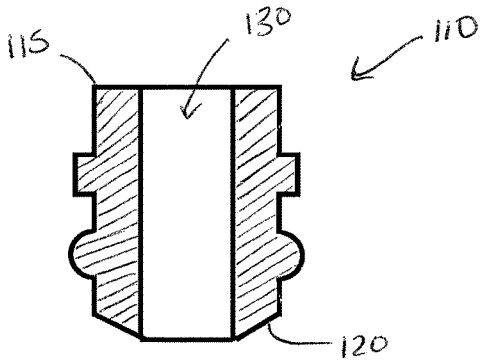
Figure 9C:
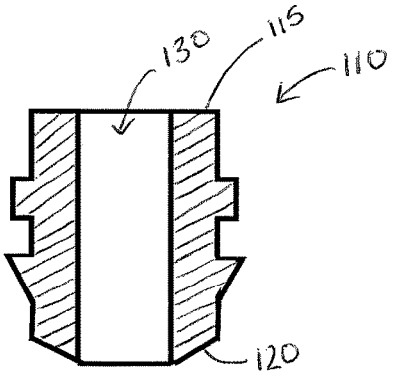
Figure 9D:
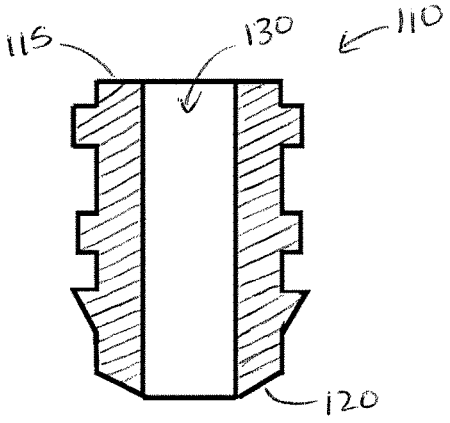

FIGS. 4 and 5 illustrate respective cross sectional views of the actuation member of FIG. 1, with FIG. 4 illustrating the rear half of the actuation member of FIG. 1 as viewed from the front, and with FIG. 5 illustrating the front half of the actuation member of FIG. 1 as viewed from the rear. FIGS. 6-8 depict front, side and bottom views, respectively of the actuation member depicted in FIG. 1.

FIGS. 9A-9D illustrate, in cross sectional views, examples of different shapes and configurations of one or more protrusions on the outer surface of the actuation members of the present invention.

Figure 10:
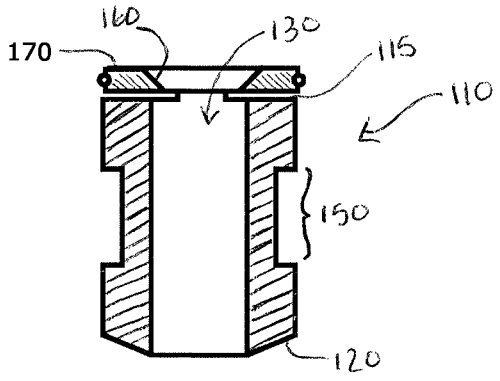
FIG. 10 depicts a cross sectional view of an actuation member in accordance with another embodiment of the present invention, having a chamfered downhole end and grooves on the outer surface, and a plug seat integral with the uphole end of the hollow body.
Figure 11:
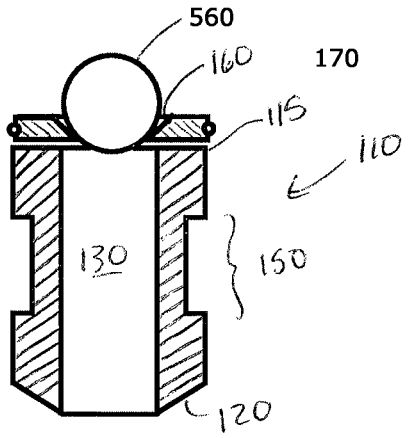
FIG. 11 depicts the actuation member of FIG. 10 with a plug on the plug seat.

FIG. 10 illustrates, in cross-sectional view, an example of an actuation member having a plug seat-defining member 170 integral with the uphole end of the hollow body, a chamfered downhole end and grooves on the outer surface. FIG. 11 depicts the actuation member of FIG. 10 with a plug 560 on the plug seat 160.

Figure 12:
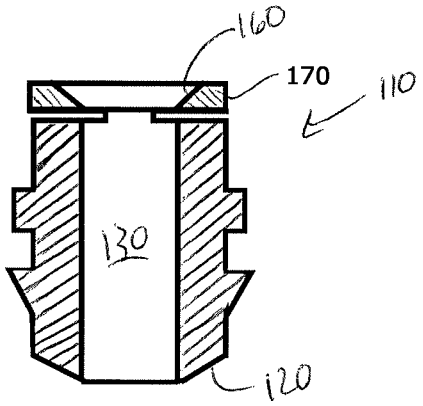
FIG. 12 depicts a cross sectional view of an actuation member in accordance with another embodiment of the present invention, having a chamfered downhole end, protrusions on the outer surface, and plug seat integral with the uphole end of the hollow body.
Figure 13:
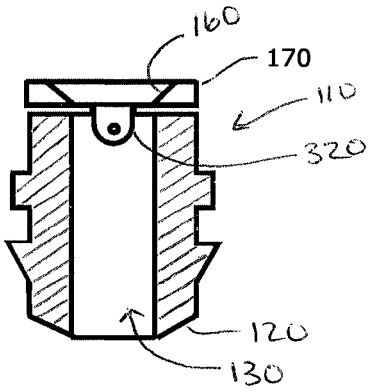
FIG. 13 depicts a cross sectional view of an actuation member in accordance with another embodiment of the present invention, having a chamfered downhole end, grooves on the outer surface, and plug seat coupled to the uphole end of the hollow body.

FIGS. 12 and 13 illustrate, in cross-sectional views, examples of an actuation member having a plug seat-defining member (170) integral with the uphole end of the hollow body, and an actuation member having a plug seat-defining member (170) coupled to the uphole end of the hollow body, respectively.

Figure 14:
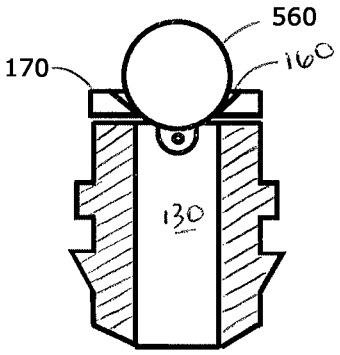
FIG. 14 depicts the actuation member of FIG. 13 with a plug on the plug seat.
Figure 15:
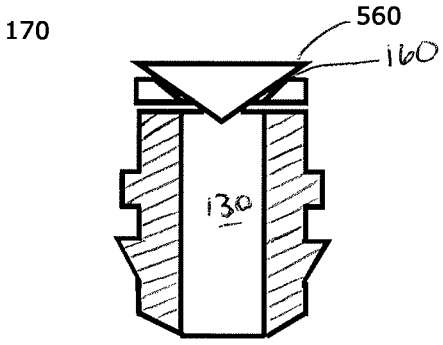
FIG. 15 depicts the actuation member of FIG. 12 with a plug on the plug seat.
Figure 16A:
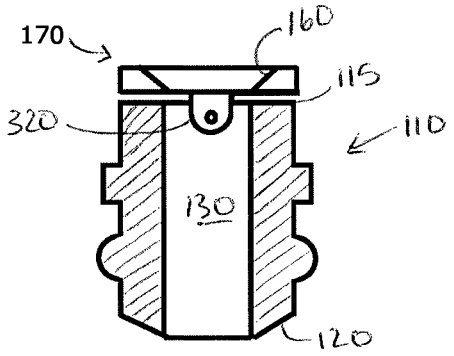
FIGS. 16A-16D depict different configurations and positioning of multiple protrusions on the outer surface of embodiments of the actuation members in accordance with the present invention.
Figure 16B:
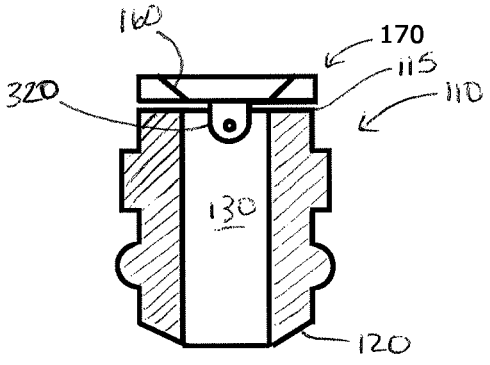
Figure 16C:
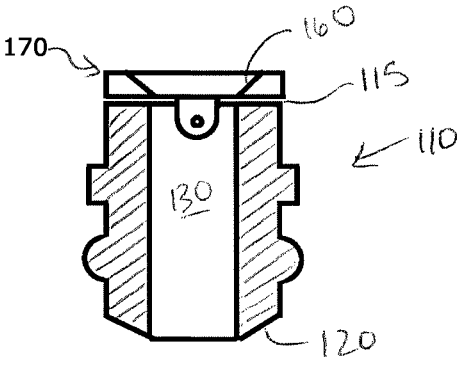
Figure 16D:
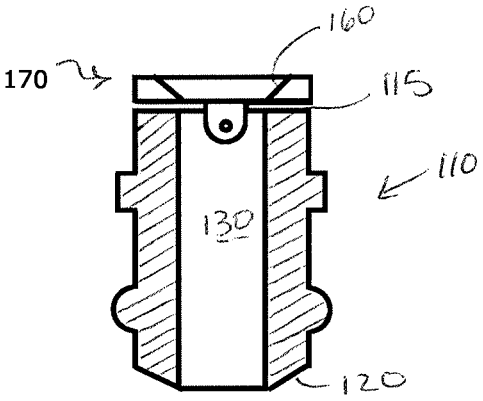

FIGS. 14 and 15, illustrate, in cross sectional views, different shapes of the plug members seated on the plug seats.

FIGS. 16A-16D illustrate, in cross sectional views, examples of different configurations, relating sizes and positioning of one or more protrusions on the outer surface of the actuation members of the present invention.

Figure 17:
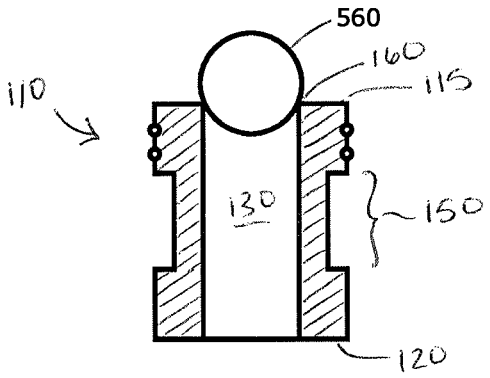
FIG. 17 depicts a cross section view of an actuation member in accordance with another embodiment of the present invention.
Figure 18:
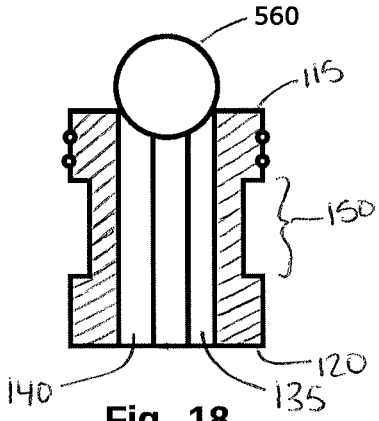
FIG. 18 depicts a cross section view of the actuation member of FIG. 17 from a rotated view.
Figure 19:
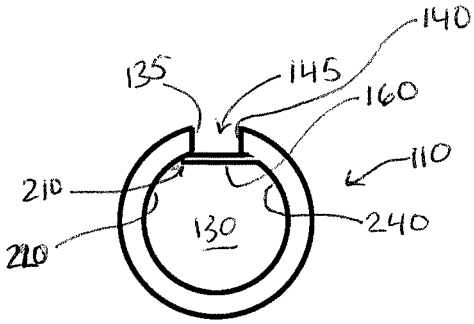
FIG. 19 depicts the bottom view of FIG. 17 showing the wiper portion in accordance with an embodiment of the present invention.

FIGS. 17 and 18 illustrate, in cross sectional views, an example of the actuation member wherein plug seat is formed by a wiper member, and seating a ball shaped plug member. FIGS. 17 and 18 also show o-rings at the up hole end. FIG. 19 depicts the bottom view of FIG. 17.

Figure 20A:
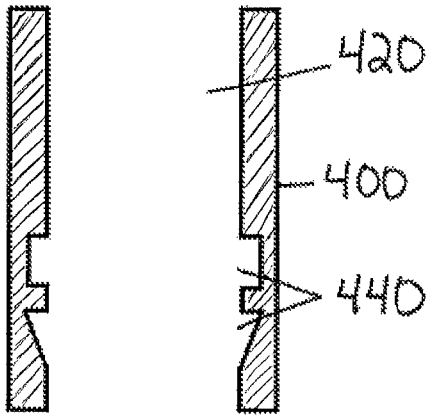
FIG. 20A depicts a cross sectional view of a casing member disposed in a wellbore and FIG. 20B depict a corresponding actuation member in latching engagement with the casing member of FIG. 20A.
Figure 20B:
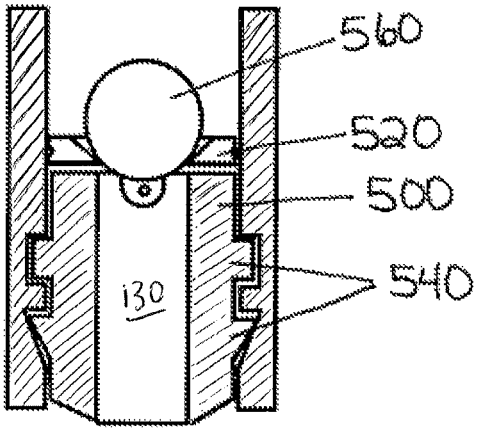

FIG. 20A and 20B illustrate, in cross sectional views, an example of an actuation member (500) being installed in a casing member (400) disposed in a wellbore (not shown) without a sliding sleeve, and the latching engagement between the actuation member and the casing.

The casing member (400) includes an aperture (420) for receiving the actuation member (500) therein. The aperture has a diameter which is approximately the same as the diameter of the actuation member, so that the actuation member can enter and potentially pass through the aperture. The casing member has grooves (440) provided in its inner wall.

Actuation member (500) is configured for travelling down the borehole in a longitudinal direction and matingly engage with the casing member. The configuration includes sizing and shaping of the actuation member to closely match the aperture of casing, placing of a plug member 560 (such as a ball) into a corresponding plug member seat (520) of the actuation member, and providing protrusion (540) corresponding with the grooves (440) of the casing for the mating engagement therewith.

The plug member (560) blocks a longitudinal aperture of the actuator member which, when unblocked, allows fluidic communication between an uphole end of the actuation member and a downhole end of the actuation member. Hydraulic fluid is applied under pressure uphole of the actuation member (500). Due to its slidability within the casing and its size, shape and blocked longitudinal aperture, the actuation member (500) is motivated to move downhole under the hydraulic fluid pressure.

A predetermined amount of hydraulic pressure imparts a force onto the actuation member and forces a mating engagement between the protrusions of the actuation member (500) with the grooves of the casing member (400), thereby closing the casing borehole and allowing release of wire lines to perforate the casing in a section above the actuation member.

FIGS. 21A-21D illustrate in sectional views, operation of the actuation member (800) with respect to the corresponding sliding sleeve member (600) in a wellbore casing (700).

The sliding sleeve member (600) includes an aperture (620) for receiving the actuation member (800) therein. The aperture has a diameter which is approximately the same as the diameter of the actuation member, so that the actuation member can enter and potentially pass through the aperture. The sliding sleeve member has grooves (640) provided in its inner wall.

The actuation member (800) is configured for travelling down the borehole in a longitudinal direction and matingly engage with the sliding sleeve. The configuration includes sizing and shaping the actuation member to closely match the aperture of sliding sleeve, placing of a plug member 880 (such as a ball) into a corresponding plug member seat (820) of the actuation member, and providing protrusions (840) corresponding with the grooves (640) of the sliding sleeve for mating engagement therewith.

The plug member (880) blocks a longitudinal aperture of the actuator member which, when unblocked, allows fluidic communication between an uphole end of the actuation member and a downhole end of the actuation member. Hydraulic fluid is applied under pressure uphole of the actuation member (800). Due to its slidability within the sleeve and its size, shape and blocked longitudinal aperture, the actuation member (800) is motivated to move downhole under the hydraulic fluid pressure.

The sliding sleeve member (600) initially covers a port (740) of the casing (700) in the borehole. The port can extend partially or fully around the circumference of the casing, and multiple such ports may be provided. The sliding sleeve member (600) is fixed in place using shear pins (650). Once the shear pins (650) have been broken due to application of a predetermined amount of force applied in the longitudinal direction, the sliding sleeve member (600) is slidable within the borehole. As such, the sliding sleeve member (600) is configured, upon application of the predetermined amount of force in the longitudinal direction to move downhole in the longitudinal direction, thereby uncovering the port (740).

The mating engagement of the protrusions of the actuation member (800) with the grooves of the sliding sleeve member (600) allows a transfer of the predetermined amount of force (required to slide the sliding sleeve) from the actuation member to the sleeve member. In more detail, hydraulic pressure imparts the predetermined amount of force onto the actuation member and, by virtue of the mating connection between the actuation member (800) and the sliding sleeve member (600), the force causes shearing of the shear pins (650) and sliding of the sliding sleeve member.

Figure 21A:
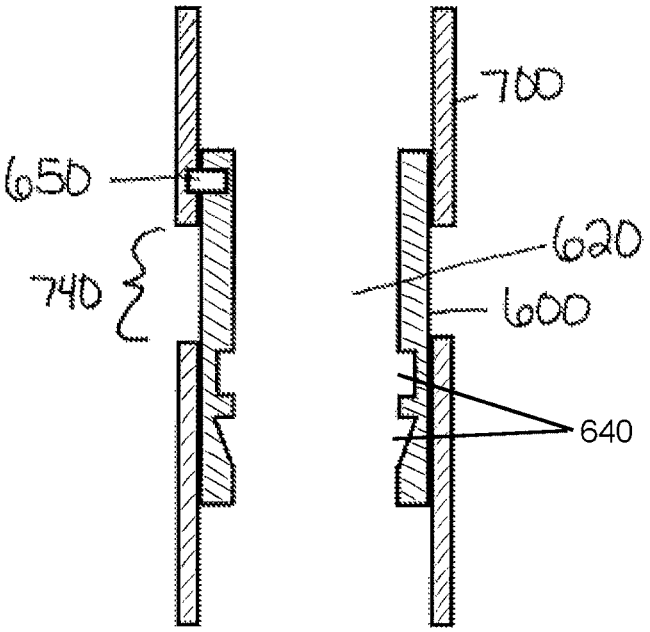
FIGS. 21A-21D illustrate in sectional views, operation of an actuation member with respect to the corresponding sliding sleeve member in a wellbore casing, in accordance with another embodiment of the present invention.
Figure 21B:
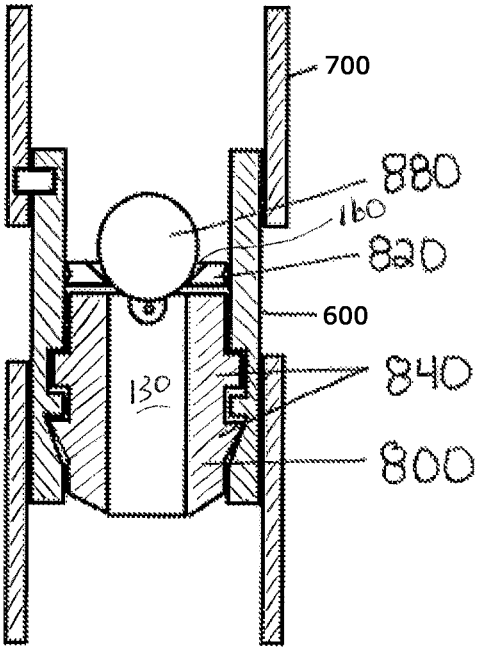
Figure 21C:
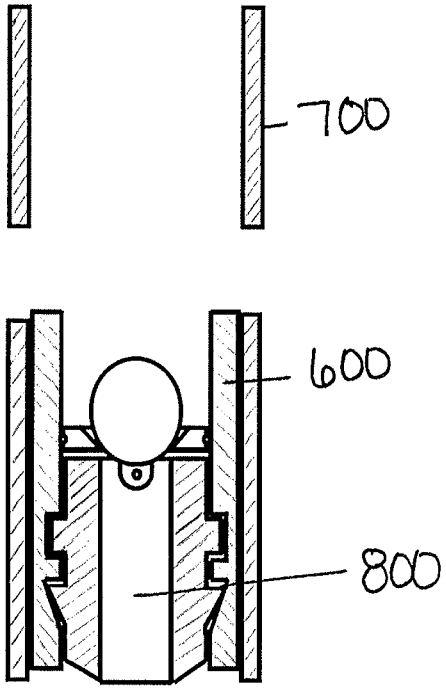
Figure 21D:
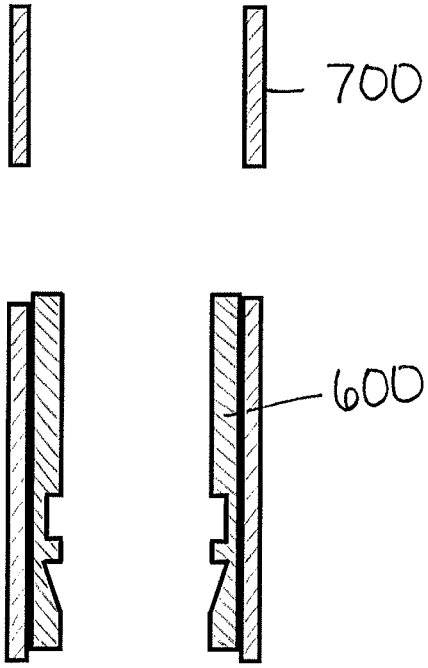

In FIG. 21A, the sliding sleeve member initially covers the ports. In FIG. 21B, the actuation member has entered the aperture of the sliding sleeve member, and the grooves of the sliding sleeve member have engaged the protrusions of the actuation member. In FIG. 21C, the sliding sleeve member has moved downhole to uncover the ports, due to hydraulic pressure applied uphole of the engaged actuation member. It is noted that the shear pins have been broken under force to allow this movement. In FIG. 21D, the actuation member has been removed (e.g. dissolved), in order to allow fluid flow past the sliding sleeve member.

It should be understood that any of the foregoing configurations and specialized components or may be interchangeably used with any of the apparatus or systems of the preceding embodiments. Although illustrative embodiments are described hereinabove, it will be evident to one skilled in the art that various changes and modifications may be made therein without departing from the scope of the disclosure. It is intended in the appended claims to cover all such changes and modifications that fall within the true spirit and scope of the disclosure.

Although embodiments of the invention have been described above, it is not limited thereto and it will be apparent to those skilled in the art that numerous modifications form part of the present invention insofar as they do not depart from the spirit, nature and scope of the claimed and described invention.

We claim:

1. An engaging member for travelling down a borehole of a casing disposed in a wellbore to engage with one or more locate profiles provided inside the casing, the engaging member comprising:

a body extending between an uphole end and a downhole end and defining an open internal passage extending between the uphole end and the downhole end, the body including two edge portions defining respective free ends, each free end extending between the uphole end and the downhole end of the body and being separate and moveable relative to one another wherein relative movement between the free ends is effective for causing resilient deformation of the body, said resilient deformation effective for causing at least a reduction in a cross-sectional area defined by the internal passage of the body; and a plug seat configured to receive a plug for blocking the internal passage;

wherein:

an outer surface of the body comprises one or more protrusions and/or grooves configured to matingly engage with at least a corresponding one of the one or more locate profiles provided in the casing;

mating engagement of the one or more protrusions and/or grooves defined by the outer surface of the body with the corresponding one of the one or more locate profiles provided in the casing is effected in response to resilient deformation of the body such that the engaging member is coupled to the casing; and the free ends defined by the two edge portions are configured such that:

the body is a generally spiral-shaped body including more than one and less than two rotations; and an outer face of a portion of the outer surface of the body that is proximate to one of the free ends is configured to wipingly engage an inner face of a portion of the body proximate to the other free end defined the other one of the two edge portions.

2. The engaging member as claimed in claim 1, wherein: the one or more locate profiles are defined by one or more grooves and/or protrusions provided on the inner surface of the casing.

3. The engaging member as claimed in claim 1, wherein: the casing has one or more ports extending through the casing, and the casing further comprises:

a sliding sleeve member including an internal passage configured for receiving the engaging member, the sliding sleeve member being disposed within the borehole defined by the casing to initially cover one of the one or more ports, and configured for downhole displacement relative to the casing in response to a predetermined amount of force applied to the sliding sleeve member in the downhole direction to effect uncovering of the port;

wherein the corresponding one of the one or more locate profiles are defined by one or more grooves and/or protrusions provided on an inner surface of the sliding sleeve member, and mating engagement of the one or more protrusions and/or grooves defined by the engaging member with the corresponding one of the locate profiles is such that the engaging member is coupled to the sliding sleeve member with effect that the engaging member translates together with the sliding sleeve member in response to downhole displacement of the sliding sleeve member in response to application of the predetermined amount of force while a plug is seated on the plug seat.

4. The engaging member of claim 1, wherein the plug seat is defined by a plug seat-defining member that is coupled to the body by a coupling piece located generally diametrically opposite from the free ends defined by the two edge portions.

5. The engaging member of claim 4, wherein the coupling piece spans an arc of between 5 degrees and 45 degrees.

6. The engaging member of claim 1, wherein at least a portion of the engaging member is formed of one of: a dissolvable material, a degradable material, or a material that is mechanically destructible under a milling or other operation.

7. An engaging apparatus configured for deployment through a wellbore passage defined by a wellbore feature of a wellbore that extends into a subterranean formation, the wellbore feature defining a locate profile, the apparatus comprising:

an engager including:

two free ends that are spaced apart and disposed for displacement relative to one another; and a locator configured for interacting with the locate profile;

wherein:

the apparatus is co-operable with the wellbore feature such that, in response to emplacement of the locator in an interaction-effective disposition relative to the locate profile, a locating deformation of the engager is effected such that there is relative movement between the free ends, with effect that the locator interacts with the locate profile such that the engager becomes coupled to the wellbore feature; and at least a portion of the apparatus is formed of one of: a dissolvable material, a degradable material, or a material which is mechanically destructible under a milling or other mechanical operation; and wherein the relative movement between the free ends includes, for at least one of the free ends, radial movement relative to a central longitudinal axis of the engaging apparatus.

8. The engaging apparatus as claimed in claim 7, wherein:

the locator includes a protrusion; and the locate profile includes a complementary recess.

9. The engaging apparatus as claimed in claim 7, wherein:

the locator includes a recess; and the locate profile includes a complementary protrusion.

10. The engaging apparatus as claimed in claim 7, wherein:

the locating deformation is a resilient deformation.

11. The engaging apparatus as claimed in claim 7, wherein:

the coupling of the engager to the wellbore feature is a releasable coupling.

12. The engaging apparatus as claimed in claim 7, wherein:

the engager defines an internal passage; and the relative movement of the free ends effects a change to a cross-sectional area defined by the internal passage.

13. The apparatus as claimed in claim 7, wherein:

the engager defines an internal passage;

the apparatus further comprising:

a plug seat configured for receiving a plug such that seating of a plug on the plug seat is with effect that the internal passage is blocked;

wherein:

the plug seat is defined by a plug seat-defining member that is coupled to an uphole end of the engager.

14. The engaging apparatus as claimed in claim 7, wherein:

each one of the at least one of the free ends is biased for radial displacement relative to the central longitudinal axis of the engaging member.

15. The engaging apparatus as claimed in claim 7, wherein:

each one of the free ends is a free end that extends longitudinally from an uphole end to a downhole end of the engaging apparatus.

16. The engaging apparatus as claimed in claim 7, wherein:

the engager is configured such that the two free ends oppose each other.

17. The engaging apparatus as claimed in claim 7, wherein:

the radial movement includes displacement of the at least one of the free ends along an arcuate path.

18. An engaging apparatus configured for deployment through a wellbore passage defined by a wellbore feature of a wellbore that extends into a subterranean formation, the wellbore feature defining a locate profile, the apparatus comprising:

an engager defining an internal passage, the engager including:

two free ends that are spaced apart and disposed for displacement relative to one another; and a locator configured for interacting with the locate profile; and a plug seat configured for receiving a plug such that seating of the plug on the plug seat is with effect that the internal passage is blocked;

wherein:

the plug seat is integrally formed with the engager;

the apparatus is co-operable with the wellbore feature such that, in response to emplacement of the locator in an interaction-effective disposition relative to the locate profile, a locating deformation of the engager is effected such that there is relative movement between the free ends, with effect that the locator interacts with the locate profile such that the engager becomes coupled to the wellbore feature;

and wherein the relative movement between the free ends includes, for at least one of the free ends, radial movement relative to a central longitudinal axis of the engaging apparatus.

19. The engaging apparatus as claimed in claim 18, wherein:

at least a portion of the apparatus is formed of one of: a dissolvable material, a degradable material, or a material which is mechanically destructible under a milling or other mechanical operation.

20. An engaging apparatus configured for deployment through a wellbore passage defined by a wellbore feature of a wellbore that extends into a subterranean formation, the wellbore feature defining a locate profile, the apparatus comprising:

an engager defining an internal passage, the engager including:

two free ends that are spaced apart and disposed for displacement relative to one another; and a locator configured for interacting with the locate profile;

and a plug seat configured for receiving a plug such that seating of a plug on the plug seat is with effect that the internal passage is blocked;

wherein:

the plug seat is defined by a plug seat-defining member that is coupled to an uphole end of the engager;

the coupling of the plug seat-defining member to the engager is effected diametrically opposite to the free ends;

and the apparatus is co-operable with the wellbore feature such that, in response to emplacement of the locator in an interaction-effective disposition relative to the locate profile, a locating deformation of the engager is effected such that there is relative movement between the free ends, with effect that the locator interacts with the locate profile such that the engager becomes coupled to the wellbore feature; and wherein the relative movement between the free ends includes, for at least one of the free ends, radial movement relative to a central longitudinal axis of the engaging apparatus.

21. An engaging apparatus configured for deployment through a wellbore passage defined by a wellbore feature of a wellbore that extends into a subterranean formation, the wellbore feature defining a locate profile, the apparatus comprising:

an engager including:

two free ends that are spaced apart and disposed for displacement relative to one another; and a locator configured for interacting with the locate profile;

wherein:

the apparatus is co-operable with the wellbore feature such that, in response to emplacement of the locator in an interaction-effective disposition relative to the locate profile, a locating deformation of the engager is effectuated with effect that the locator interacts with the locate profile such that the engager becomes coupled to the wellbore feature, wherein the locating deformation effects relative movement between the free ends;

wherein:

the engager has a generally C-shaped cross-section such that the free ends are separated by a gap disposed within a perimeter defined by the engager.

22. The apparatus as claimed in claim 21, wherein:

the locating deformation effects displacement of the free ends relative to one another that is effective to cause a reduction in the gap.

23. The apparatus as claimed in claim 22, wherein:

the locating deformation is a resilient deformation; and the interaction, of the locator with the locate profile, that is effective for coupling the engager to the wellbore feature, is effected in response to a material bias of the engager that is induced by a transitional deformation that effects displacement of the free ends that causes the reduction in the gap, the material bias effective for inducing displacement of the free ends relative to one another that is effective for increasing the gap.

24. An engaging apparatus configured for deployment through a wellbore passage defined by a wellbore feature of a wellbore that extends into a subterranean formation, the wellbore feature defining a locate profile, the apparatus comprising:

an engager including:

two free ends that are spaced apart and disposed for displacement relative to one another; and a locator configured for interacting with the locate profile;

wherein :

the apparatus is co-operable with the wellbore feature such that, in response to emplacement of the locator in an interaction-effective disposition relative to the locate profile, a locating deformation of the engager is effectuated with effect that the locator interacts with the locate profile such that the engager becomes coupled to the wellbore feature, wherein the locating deformation effects relative movement between the free ends;

the free ends are configured relative to one another such that the engager is a generally spiral-shaped engager defining more than one and less than two rotations; and one of the free ends is inwardly disposed relative to the other one of the free ends, relative to a central axis of the apparatus, such that an outer face portion of the engager that is proximate to the one of the free ends that is inwardly disposed relative to the other one of the free ends is configured to wipingly engage an inner face portion of the engager that is proximate to the other one of the free ends in response to relative movement of the free ends.

25. An engaging apparatus configured for deployment through a wellbore passage defined by a wellbore feature of a wellbore that extends into a subterranean formation, the wellbore feature defining a locate profile, the apparatus comprising:

an engager including:

two free ends that are spaced apart and disposed for displacement relative to one another; and a locator configured for interacting with the locate profile;

wherein:

the apparatus is co-operable with the wellbore feature such that, in response to emplacement of the locator in an interaction-effective disposition relative to the locate profile, a locating deformation of the engager is effected such that there is relative movement between the free ends, with effect that the locator interacts with the locate profile such that the engager becomes coupled to the wellbore feature;

wherein the relative movement between the free ends includes, for at least one of the free ends, radial movement relative to a central longitudinal axis of the engaging apparatus;

and the wellbore feature is a wellbore string.

26. An engaging apparatus configured for deployment through a wellbore passage defined by a wellbore feature of a wellbore that extends into a subterranean formation, the wellbore feature defining a locate profile, the apparatus comprising:

an engager including:

two free ends that are spaced apart and disposed for displacement relative to one another; and a locator configured for interacting with the locate profile;

wherein:

the apparatus is co-operable with the wellbore feature such that, in response to emplacement of the locator in an interaction-effective disposition relative to the locate profile, a locating deformation of the engager is effected such that there is relative movement between the free ends, with effect that the locator interacts with the locate profile such that the engager becomes coupled to the wellbore feature;

the relative movement between the free ends includes, for at least one of the free ends, radial movement relative to a central longitudinal axis of the engaging apparatus;

and the wellbore feature is a casing string.

27. An engaging apparatus configured for deployment through a wellbore passage defined by a wellbore feature of a wellbore that extends into a subterranean formation, the wellbore feature defining a locate profile, the apparatus comprising:

an engager including:

two free ends that are spaced apart and disposed for displacement relative to one another; and a locator configured for interacting with the locate profile;

wherein:

the apparatus is co-operable with the wellbore feature such that, in response to emplacement of the locator in an interaction-effective disposition relative to the locate profile, a locating deformation of the engager is effected such that there is relative movement between the free ends, with effect that the locator interacts with the locate profile such that the engager becomes coupled to the wellbore feature;

the relative movement between the free ends includes, for at least one of the free ends, radial movement relative to a central longitudinal axis of the engaging apparatus; and the wellbore feature includes:

(i) a casing including a flow communicator extending through the casing for effectuating flow communication between the passage within the casing and a respective zone of the subterranean formation; and (ii) a sliding sleeve member for opening and closing the flow communicator, the sliding sleeve member configured for receiving the engaging member therein;

the locate profile is defined by the sliding sleeve member; and the co-operability of the engaging member with the wellbore feature is with additional effect that:

the coupling of the engaging member to the wellbore feature, effectuated by the interaction of the locator with the locate profile, in response to the emplacement of the engager in the interactive-effective disposition relative to the locate profile is a coupling of the engager to the sliding sleeve member.

* * * * *